US005265997A

United States Patent [19]

Tuckey

[11] Patent Number: 5,265,997

[45] Date of Patent: Nov. 30, 1993

[54] TURBINE-VANE FUEL PUMP

[75] Inventor: Charles H. Tuckey, Cass City, Mich.

[73] Assignee: Walbro Corporation, Cass City, Mich.

[21] Appl. No.: 15,519

[22] Filed: Feb. 9, 1993

Related U.S. Application Data

[63] Continuation-in-part of Ser. No. 816,729, Jan. 3, 1992.

[51] Int. Cl.[5] ..... F01D 3/00

[52] U.S. Cl. ..... 415/55.1

[58] Field of Search ..... 415/55.1, 55.2, 55.3, 415/55.4, 55.5

[56] References Cited

U.S. PATENT DOCUMENTS

| | | | |
|---|---|---|---|
| 1,768,243 | 6/1930 | Ferguson | 415/55.1 |
| 1,893,616 | 1/1933 | Ferguson | 415/55.4 |
| 2,006,590 | 7/1935 | Ferguson | 415/55.1 |
| 2,671,404 | 3/1954 | Krueger . | |
| 3,259,072 | 7/1966 | Carpenter . | |
| 4,403,910 | 9/1983 | Watanabe et al. | 415/55.1 |
| 4,915,582 | 4/1990 | Nishikawa | 415/55.1 |
| 4,938,659 | 7/1990 | Bassler et al. | 415/55.1 |

FOREIGN PATENT DOCUMENTS

| | | | |
|---|---|---|---|
| 501046 | 6/1930 | Fed. Rep. of Germany | 415/55.2 |
| 555035 | 7/1932 | Fed. Rep. of Germany | 415/55.1 |

OTHER PUBLICATIONS

Frank A. Kristal, "Pumps", 1953.

*Primary Examiner*—John T. Kwon

*Attorney, Agent, or Firm*—Barnes, Kisselle, Raisch, Choate, Whittemore & Hulbert

[57] ABSTRACT

An electric-motor tubine-vane fuel pump that includes a housing having a fuel inlet and a fuel outlet, and an electric motor with a rotor responsive to application of electrical power for rotating within the housing. A pump mechanism includes a turbine impeller coupled to the rotor for corotation therewith and having a periphery with a circumferential array of pockets. An arcuate channel surrounds the impeller periphery, and is operatively coupled to the fuel inlet and outlet of the housing for delivering fuel under pressure to the outlet. The impeller periphery is formed by a continuous uninterrupted serpentine rib of uniform peripheral thickness that extends at an angle back and forth between opposed axial side edges of the impeller periphery circumferentially around the impeller forming identical truncated pyramidal pockets alternating with each other around the impeller periphery on opposite side edges of the impeller.

6 Claims, 2 Drawing Sheets

TURBINE-VANE FUEL PUMP

This application is a continuation-in-part of application Ser. No. 07/816,729 filed Jan. 3, 1992.

The present invention is directed to electric-motor fuel pumps, and more particularly to a turbine-vane fuel pump for automotive engine and like applications.

BACKGROUND AND OBJECTS OF THE INVENTION

Electric-motor turbine-vane pumps, also called turbine, periphery, tangential, regenerative, turbulence and friction pumps, have heretofore been proposed and employed for use in automotive fuel delivery systems. Pumps of this character typically include a housing adapted to be immersed in a fuel supply tank with an inlet for drawing fuel from the surrounding tank and an outlet for feeding fuel under pressure to the engine. An electric motor includes a rotor mounted for rotation within the housing and connected to a source of electrical energy for driving the rotor about its axis of rotation. A turbine impeller is coupled to the rotor for corotation therewith, and has a periphery with circumferential arrays of pockets extending around each axial edge of the periphery. An arcuate pumping channel with an inlet and outlet at opposed ends surrounds the impeller periphery for developing fuel pressure through a vortexlike action between the pockets of the rotating impeller and the surrounding channel. One example of a fuel pump of this type is illustrated in U.S. Pat. No. 3,259,072.

A general object of the present invention is to provide an electric-motor turbine-vane fuel pump of the described character that features an impeller having improved pressure and flow characteristics, particularly under hot fuel handling conditions in which the pump might otherwise be susceptible to vapor lock. Another and related object of the present invention is to provide a fuel pump of the described character featuring an improved impeller construction that is economical to manufacture and assemble into the pump arrangement. Yet another object of the invention is to provide a pump of the described character having improved impeller vane efficiency and strength.

SUMMARY OF THE INVENTION

An electric-motor turbine-vane fuel pump in accordance with the presently preferred embodiment of the invention includes a housing having a fuel inlet and a fuel outlet, and an electric motor with a rotor responsive to application of electrical power for rotation within the housing. A pump mechanism includes a turbine impeller coupled to the rotor for corotation therewith and having a periphery with a circumferential array of pockets. An arcuate channel surrounds the impeller periphery, and is operatively coupled to the fuel inlet and outlet of the housing for delivering fuel under pressure to the outlet. The impeller periphery is formed by a continuous uninterrupted serpentine rib that extends back and forth between opposed axial edges of the impeller periphery circumferentially around the impeller forming identical pockets alternating around the impeller periphery on opposite side edges of the impeller.

The serpentine rib in the preferred embodiment of the invention is of rectilinear construction, and is composed of linear reaches that extend axially across the periphery between the impeller side edges alternating with linear reaches that extend along the side edges parallel to the edges. Most preferably, the reaches that extend axially across the impeller periphery are oriented at alternating acute angles to the axis of the impeller, such that the impeller pockets have the geometry of a truncated pyramid when viewed radially of the impeller. The radially outer edge of the serpentine rib is of uniform thickness entirely around the periphery of the impeller. The circumferential dimension of each pocket at the peripheral edge of the impeller is at least equal to, and preferably is greater than, the circumferential dimension at the peripheral edge of the axially opposinq land. In the preferred embodiment of the invention, the acute angle is substantially equal to 26°. The impeller, including the rib, is preferably of monolithic molded plastic or ceramic construction, with the rib thickness increasing radially inwardly of the impeller periphery.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
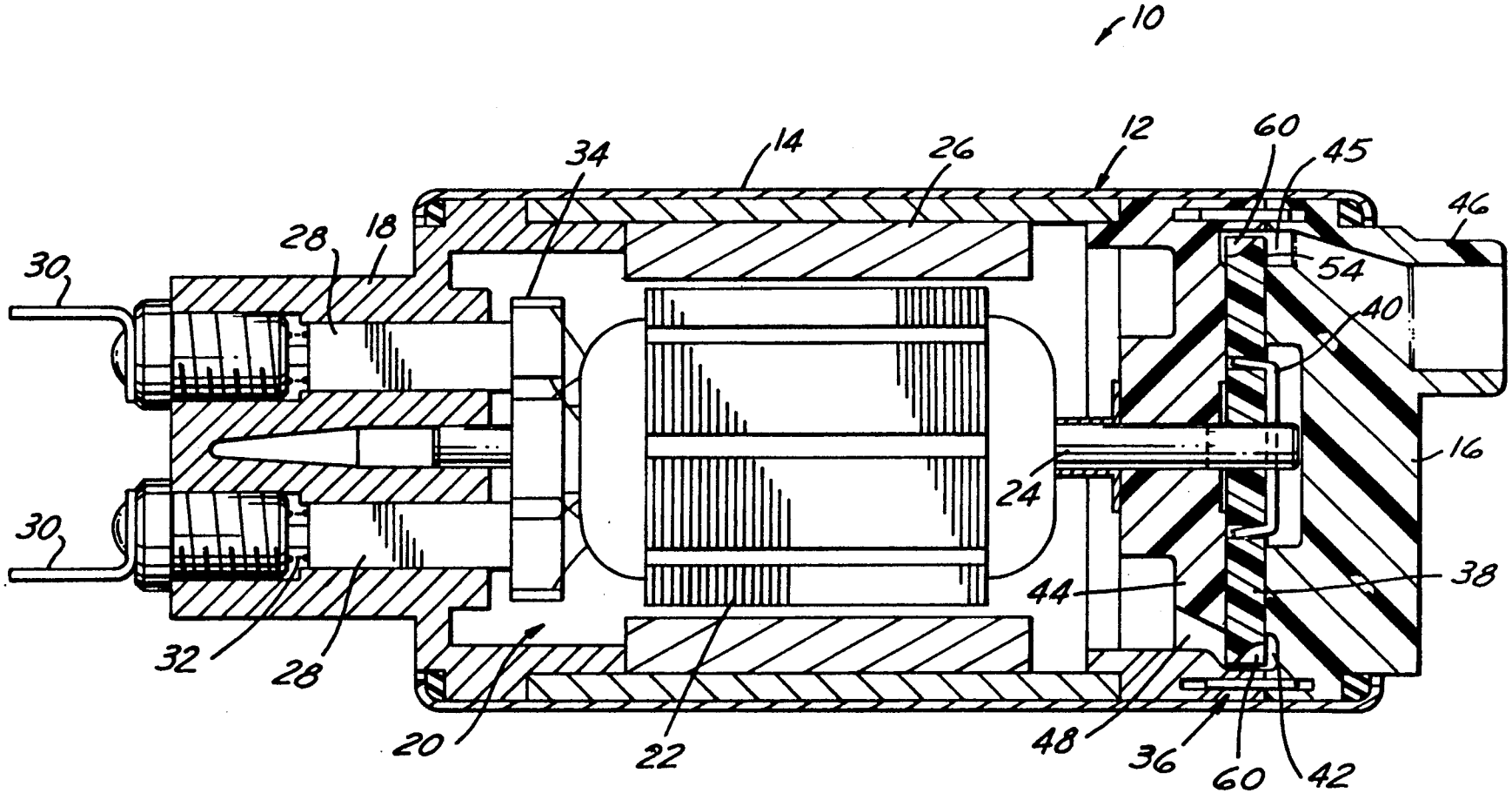
FIG. 1 is a sectional view in side elevation illustrating an electric-motor turbine-vane fuel pump in accordance with a presently preferred embodiment of the invention.
Figure 2:
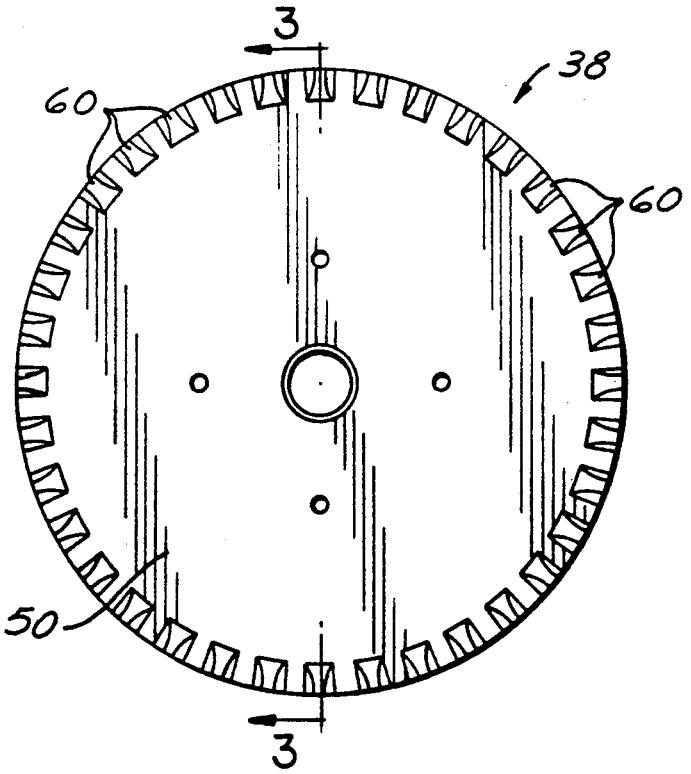
FIG. 2 is an elevational view of the impeller in the fuel pump of FIG. 1.

FIG. 1 illustrates a fuel pump 10 in accordance with a presently preferred embodiment of the invention as comprising a housing 12 formed by a cylindrical case 14 that joins axially spaced inlet and outlet end caps 16,18. An electric motor 20 is formed by a rotor 22 journalled by a shaft 24 for rotation within housing 12, and is surrounded by a permanent magnet stator 26. Brushes 28 are disposed within outlet end cap 18 and electrically connected to terminals 30 positioned externally of end cap 18. Brushes 28 are urged by springs 32 into electrical sliding contact with a commutator plate 34 carried by rotor 22 for applying electrical energy thereto, and thereby rotating rotor 22 and shaft 24 within housing 12. To the extend thus far described, pump 10 is generally similar to those disclosed in U.S. Pat. Nos. 4,352,641, 4,500,270 and 4,596,519.

The pump mechanism 36 of pump 10 includes an impeller 38 coupled to shaft 24 by a wire 40 for corotation therewith. An arcuate pumping chamber 42 circumferentially surrounds the periphery of impeller 38, and is formed by inlet end cap 16 and a port plate 44 on the opposite side of impeller 38. Channel 42 has an inlet port 45 connected to the inlet 46 that projects from end cap 16, and has an outlet port 48 that extends through plate 44 to the interior of housing 12. Fuel is thereby pumped by impeller 38 from inlet 46 through housing 12 to an outlet that extends through outlet end cap 18.

Figure 3:
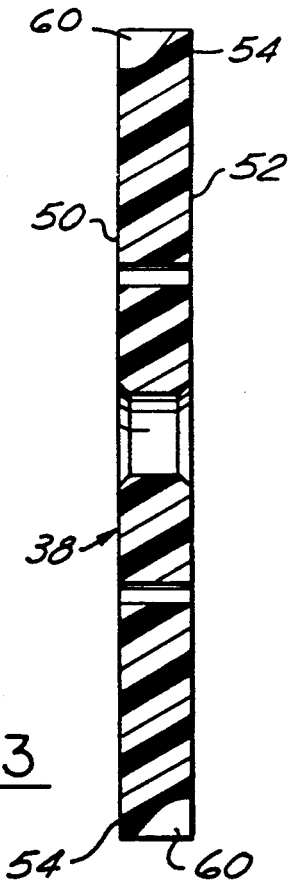
FIG. 3 is a sectional view taken substantially along the line 3—3 in FIG. 2.
Figure 4:
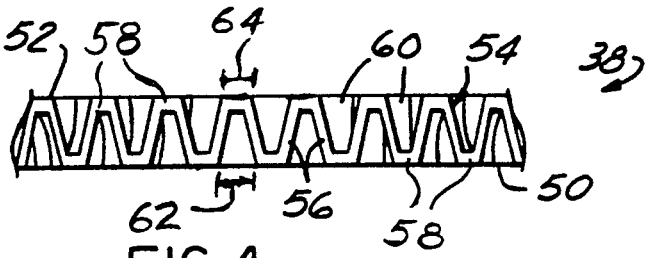
FIG. 4 is a fragmentary view of the impeller in FIGS. 2 and 3 viewed from the radial direction.
Figure 5:
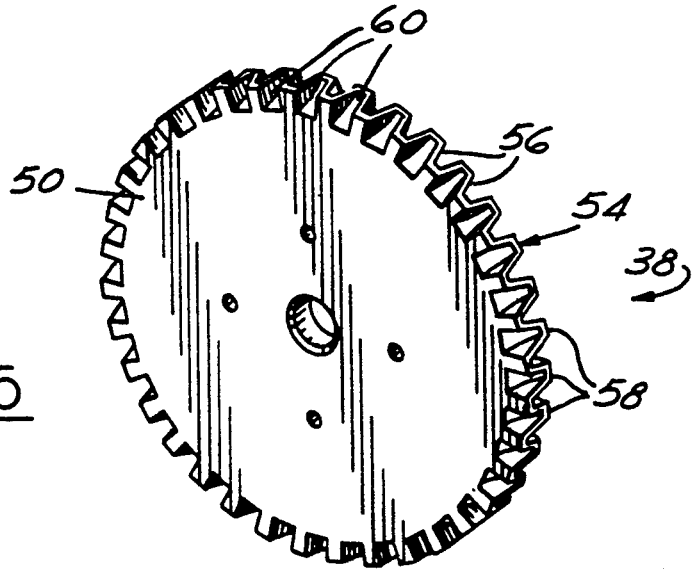
FIG. 5 is a perspective view of the impeller illustrated in FIGS. 2–4.

Impeller 38 is illustrated in detail in FIGS. 2–5. Impeller 38 is preferably of monolithic (i.e., one-piece homogeneously integral) molded plastic or ceramic construction, having the geometry of a flat disk of generally uniform thickness with parallel axially oppositely facing side faces 50,52. A continuous uninterrupted (i.e., endless) rectilinear serpentine rib 54 extends entirely around the periphery of impeller 38. The radially outer edge of rib 54 is of uniform thickness entirely around the periphery of the impeller. As best seen in FIG. 3, rib 54 increases in thickness radially inwardly of the impeller. Rectilinear serpentine rib 54 is formed by reaches 56 that extend between the opposed edges of the impeller periphery at an acute angle to the impeller axis, alternating with reaches 58 at the opposed axial edges of the periphery parallel to and contiguous with the axially oriented side faces or surfaces 50,52 of the impeller. Thus, as best seen in FIG. 4, the pockets 60 formed by rib 54 are of the identical geometry of a truncated triangle around the periphery of impeller 38, and alternate with each other on opposite sides of the impeller periphery. The circumferential dimension 62 of each pocket 60 at the peripheral edge of the impeller is at least equal to, and preferably greater than, the circumferential dimension 64 of the axially opposing reach or land 58. All dimensions 62 are identical, and all dimensions 64 are identical. In a preferred embodiment of the invention, rib reaches 56 are oriented at alternating angles substantially equal to 26° with respect to the impeller axis. In this embodiment, the impeller has a diameter of 1.150 inches and a thickness of 0.100 inches. Dimension 62 is 0.056 inches and dimension 64 is 0.045 inches, or a ratio of about 1.24.

The impeller construction so described has the advantage of providing enhanced volume for the pockets 60 while maintaining rib strength and integrity. There are no edges or ends at the impeller side faces that might chip or break during assembly or operation. Improved pumping efficiency is obtained. Indeed, it has been found that the pump illustrated in the drawings provides superior operation in so-called hot-fuel tests, in which high fuel temperature can result in vapor lock and pump malfunction. The impeller of the invention also provides greatly improved flow at high fluid pressure as compared with the prior art. It will also be appreciated that uniformity of impeller rib and pocket construction makes the impeller essentially bidirectional, which means that orientation during assembly is not critical. This feature reduces assembly cost.

I claim:

1. An electric-motor turbine-vane fuel pump that comprises:

a housing including a fuel inlet and a fuel outlet, an electric motor including a rotor and means for applying electrical energy to said motor for rotating said rotor within said housing, and pump means including a turbine impeller coupled to said rotor for corotation therewith with a periphery having a circumferential array of pockets, and means forming an arcuate channel surrounding said impeller periphery and coupled to said inlet and outlet, said impeller periphery comprising a continuous uninterrupted serpentine rib of rectilinear construction extending between opposed axial side edges of said impeller periphery circumferentially around said impeller forming identical pockets alternating with each other around said periphery on opposite side edges of said impeller, said rectilinear serpentine rib having a radially outer edge of uniform thickness entirely around said impeller periphery and being composed of straight reaches that extend axially across said periphery between said impeller side edges alternating with straight reaches that extend along said side edges parallel with said edges, said reaches that extend axially across said periphery being oriented at alternating acute angles to the axis of said impeller, such that said pockets have a geometry of a truncated pyramid viewed radially of said impeller, each said pocket having a circumferential dimension at said impeller periphery that is at least equal to the circumferential dimension of the reach at the axially opposing side edge of said impeller.

2. The fuel pump set forth in claim 1 wherein each said pocket circumferential dimension is greater than the said circumferential dimension of the opposing reach.

3. The fuel pump set forth in claim 2 wherein the ratio of said pocket circumferential dimension to said reach circumferential dimension is about 1.24.

4. The fuel pump set forth in claim 1 wherein said acute angle is substantially equal to 26°.

5. The fuel pump set forth in claim 1 wherein said impeller including said ribs is of monolithic construction.

6. The fuel pump set forth in claim 1 wherein thickness of said rib increases radially inwardly of said periphery.

* * * * *